United States Patent [19]

Kitagaki et al.

[11] Patent Number: 4,936,107

[45] Date of Patent: Jun. 26, 1990

[54] EXTERNAL HEAT EXCHANGE UNIT WITH PLURALITY OF HEAT EXCHANGER ELEMENTS AND FAN DEVICES AND METHOD FOR CONTROLLING FAN DEVICES

[75] Inventors: Toshio Kitagaki; Fumihiro Kawano, both of Fuji, Japan

[73] Assignee: Kabushiki Kaisha Toshiba, Kawasaki, Japan

[21] Appl. No.: 268,857

[22] Filed: Nov. 9, 1988

[30] Foreign Application Priority Data

Nov. 13, 1987 [JP] Japan ..... 62-288124

[51] Int. Cl.[5] ..... F25B 39/04

[52] U.S. Cl. ..... 62/184; 62/DIG. 17

[58] Field of Search ..... 62/184, 183, 181, DIG. 17

[56] References Cited

U.S. PATENT DOCUMENTS

| | | | |
|---|---|---|---|
| 3,152,455 | 10/1964 | Ware | 62/184 |
| 3,403,314 | 9/1968 | Maynard | 62/184 |
| 3,478,532 | 11/1969 | Cootey et al. | 62/181 X |
| 3,817,451 | 6/1974 | Ramsey | 62/184 X |
| 4,325,223 | 4/1982 | Cantley | 62/126 |

FOREIGN PATENT DOCUMENTS

| | | |
|---|---|---|
| 59-14679 | 4/1984 | Japan . |
| 2032085 | 4/1980 | United Kingdom . |
| 2067275 | 7/1981 | United Kingdom . |

*Primary Examiner*—Harry B. Tanner

*Attorney, Agent, or Firm*—Cushman, Darby & Cushman

[57] ABSTRACT

An air conditioning apparatus includes an external heat-exchanger having upper and lower side heat-exchanger elements, arranged in a vertical direction, each having a plurality of fluid pipes, upper and lower fan devices disposed opposite to corresponding heat-exchanger elements, and a temperature sensor disposed on one end (discharge side during cooling) of the upper-most fluid pipe of the upper side heat-exchanger element for outputting a detection signal indicating the condensation temperature of the external heat-exchanger corresponding to the condensation pressure of the external heat-exchanger. The rotation speed of the upper side fan device is regulated in accordance with the detection signal from the sensor to control the condensation pressure of the upper and lower side heat-exchanger elements within a prescribed range.

9 Claims, 4 Drawing Sheets

EXTERNAL HEAT EXCHANGE UNIT WITH PLURALITY OF HEAT EXCHANGER ELEMENTS AND FAN DEVICES AND METHOD FOR CONTROLLING FAN DEVICES

BACKGROUND OF THE INVENTION

1. Field of the invention

This invention relates, in general, to air conditioning apparatus including an internal heat-exchanger and a relatively large external heat-exchanger for cooling-/heating a relatively large space. In particular, the invention relates to detection of the condensation temperature of such a large external heat-exchanger. The invention also relates to a method for controlling the rotation speed of an external fan device which provides air to the external heat-exchanger in accordance with the detection result.

2. Description of the related art

As shown in FIG. 1, a conventional heat-pump type air conditioner typically includes a compressor 11, a four-way valve 13, an internal heat-exchanger 15, a decompression device (e.g., expansion valve) 17, and an external heat-exchanger 19 connected in series by a fluid pipe 21. An external fan 23 and an internal fan 25 are respectively disposed opposite to corresponding heat-exchangers 15 and 19. A sensor 27 is attached to pipe 21 on one side of external heat-exchanger 15, which is the refrigerant discharge side during cooling. Sensor 27 detects the condensation temperature of external heat-exchanger 15. External fan 23 is controlled by a control circuit 29 in response to a detection signal. The detection signal fed from sensor 27 indicates the condensation temperature. Internal fan 25 also is controlled by control circuit 29 in response to temperature changes in a defined space to be air conditioned.

In such a conventional air conditioner as described above, a large external heat-exchanger is needed to enhance heat-exchange efficiency. However, flow resistance of the heat-exchanger increases because of the long serial fluid passage used in such large external heat-exchangers, and therefore, the flow rate of refrigerant decreases. To solve the above-described problem, the long serial fluid passage of the large heat-exchanger is divided into several passage elements 31*a*, 31*b* and 31*c*, as shown in FIG. 2. Each passage element 31*a*, 31*b*, 31*c* normally is arranged in a vertical direction. One end (intake side during cooling) of each passage element 31*a*, 31*b*, 31*c* is connected to a header pipe 33. The other ends (discharge side during cooling) of each passage element 31*a*, 31*b*, 31*c* are commonly connected to a collector 35. The above constructed external heat-exchanger 15 is connected to the refrigerating circuit shown in FIG. 1 through a pair of connection valves 37. Therefore, the passage elements 31*a*, 31*b*, and 31*c* are connected in parallel with one another. A temperature sensor 39, e.g., a thermistor, is disposed at the other end of the lower-most side passage element 31*c*, which is the discharge side during cooling, to detect the defrosting state during the defrosting operation.

In the above-described conventional air conditioner including a relatively large external heat-exchanger which has a plurality of path elements the use of condensation pressure control wherein the condensation pressure of the external heat-exchanger is controlled within a prescribed range by regulating the rotation speed of the external fan is not practically effective for cooling. In general, changes in condensation pressure of the external heat-exchanger substantially correspond to changes in condensation temperature of the external heat-exchanger. As shown in FIG. 1, the condensation temperature of external heat-exchanger 15 is detected by sensor 27 disposed at the discharge side of external heat-exchanger 15. When external temperature decreases below a prescribed level, changes in condensation temperature of the external heat-exchanger do not correspond to changes in condensation pressure thereof. This is because a liquidized refrigerant tends to stay at a portion of the pipe where sensor 39 is disposed. Furthermore, refrigerant at the portion of pipe where sensor 39 is disposed is in a supercooling state, as indicated by point A in FIG. 3, which shows a mollier diagram. According to FIG. 3, the condensation temperature of external heat-exchanger 15 is constant even if the condensation pressure changes in the supercooling area. Therefore, it is suitable to detect a defrost state when sensor 39 is disposed on the pipe of the other end (discharge side during cooling) of the lower-most side passage element 31*c*. However, it is unsuitable to use the output of sensor 39 for controlling the rotation speed of the external fan. If such an output is used for controlling the rotation speed of the external fan during cooling in the spring or fall, an undesirable reduction in condensation pressure occurs when the external temperature decreases. Thus, a sufficient throttle action is not performed by the decompression device, and liquidized refrigerant returns into the compressor. As a result, damage of the compressor is caused by liquid compression. A shortage of lubricating oil in the compressor also occurs because of the mixing of lubricating oil into the liquidized refrigerant.

SUMMARY OF THE INVENTION

Accordingly, it is an object of the present invention to accurately detect changes in the condensation temperature of an external heat-exchanger including upper and lower heat-exchanger units each having a fluid passage.

It is another object of the invention to effectively control the condensation pressure of an external heat-exchanger by regulating the rotation speed of the external fan device.

To accomplish the above-described objects, an external heat-exchange unit includes a compressor for compressing refrigerant, at least upper and lower side external heat-exchangers arranged in a vertical direction for condensing refrigerant, a sensor for detecting the condensation temperature of the upper side external heat-exchanger at a location of the apparatus where changes in the condensation temperature correspond to changes in the condensation pressure of the upper side external heat-exchanger, and a control section responsive to the sensor for controlling the condensation pressure of the upper side external heat-exchanger within a prescribed range. The control section may include at least upper and lower side external fan devices arranged opposite to the corresponding upper and lower side external heat-exchangers for supplying air to upper and lower side external heat-exchangers, and a circuit responsive to the sensor for regulating rotation speed of the upper side external fan device.

BRIEF DESCRIPTION OF THE DRAWINGS

Other objects and advantages of the present invention will be apparent from the following detailed description of the presently preferred embodiment taken in conjunction with the accompanying drawings, in which.

DETAILED DESCRIPTION OF THE PREFERRED EMBODIMENT

Figure 5:
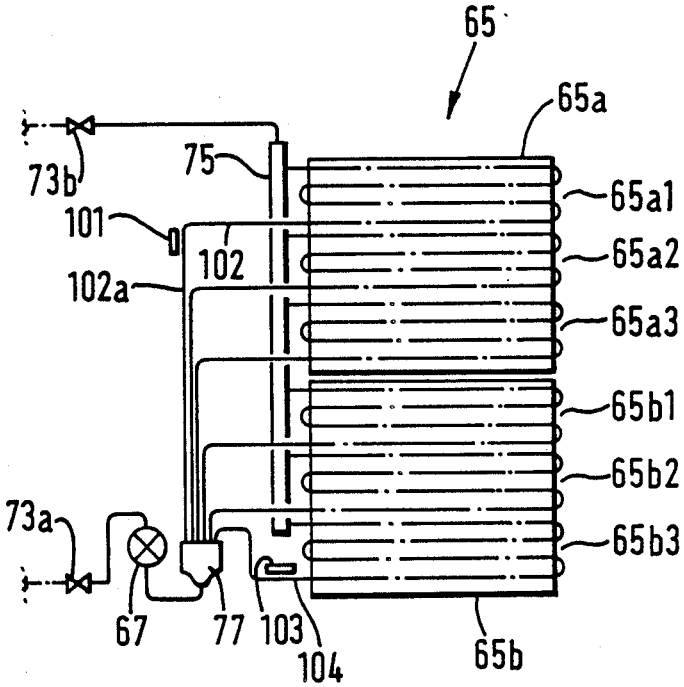
FIG. 5 is a schematic view illustrating an external heat-exchanger having a plurality of fluid passages used in the refrigerating circuit of the embodiment shown in FIG. 4.
Figure 4:
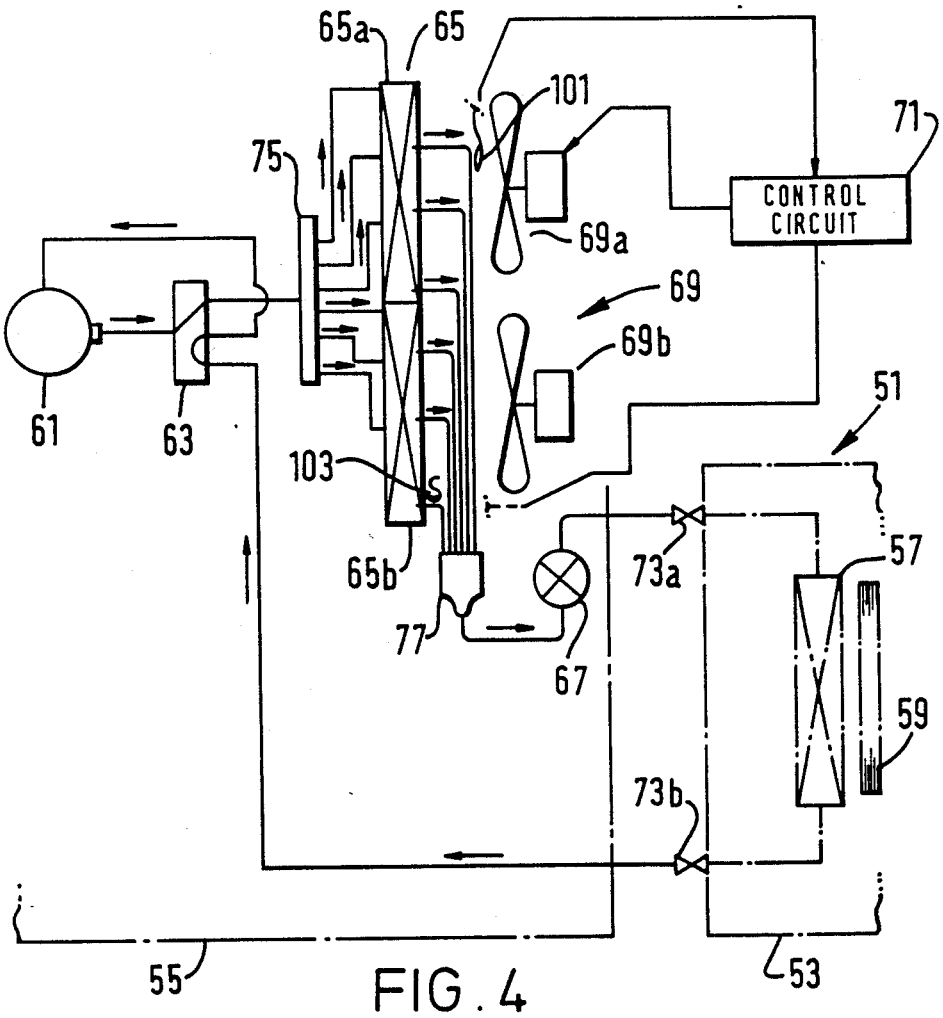
FIG. 4 is a circuit diagram illustrating a refrigerating circuit of one embodiment of the present invention.

A preferred embodiment of the present invention will now be described in more detail with reference to the accompanying drawings. Referring to FIG. 4, an air conditioning apparatus 51 includes an internal unit 53 and an external unit 55. Internal unit 53 includes an internal heat-exchanger 57 and an internal fan 59, e.g., cross flow fan, disposed opposite to internal heat-exchanger 57 for circulating conditioned air through internal heat-exchanger 57. External unit 55 includes a compressor 61, a four-way valve 63, an external heat-exchanger 65 having a plurality of heat-exchanger units. e.g., two units, a decompression device 67, a plurality of external fans 69, e.g., two fans 69*a* and 69*b*, and a control circuit 71. Decompression device 67, e.g., expansion valve, is connected for fluid communication to one end of internal heat-exchanger 57 in internal unit 53 through valve 73*a*. The other end of internal heat-exchanger 57 is connected to four-way valve 63 in external unit 55 through a valve 73*b*. As shown in FIGS. 4 and 5, external heat-exchanger 65 includes an upper side external heat-exchanger 65*a* and a lower side external beat-exchanger 65*b*. Upper side external heat-exchanger 65*a* is disposed on lower side external heat-exchanger 65*b*. Upper side external heat-exchanger 65*a* includes three individual fluid pipes $65a_1$, $65a_2$, and $65a_3$. Each fluid pipe $65a_1$, $65a_2$, $65a_3$ is turned twice in upper side external heat-exchanger 65*a*, as shown in FIG. 5. One end of each fluid pipe $65a_1$, $65a_2$, $65a_3$ is connected to a common header pipe 75. The other end of each fluid pipe $65a_1$, $65a_2$, $65a_3$ also is connected to a common collector 77. Likewise, lower side external heat-exchanger 65*b* includes three individual fluid pipes $65b_1$, $65b_2$, and $65b_3$. Each fluid pipe $65b_1$, $65b_2$, $65b_3$ is turned twice in lower side external heat-exchanger 65*b*. One end of each fluid pipe $65b_1$, $65b_2$, $65b_3$ is connected to common header pipe 75, and the other end thereof also is connected to common collector 77. Header pipe 75 is connected to four-way valve 63. Collector 77 also is connected to one end of internal heat-exchanger 57 through decompression device 67 and valve 73*a*.

Figure 7:
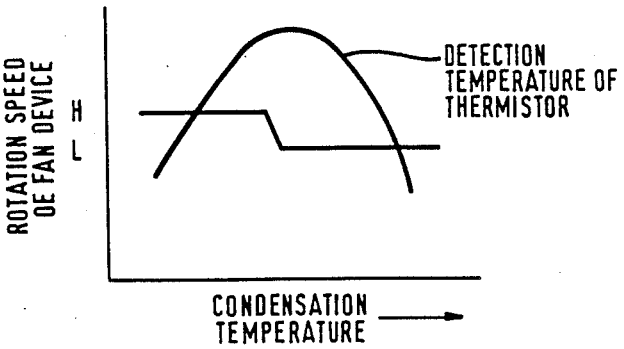
FIG. 7 is a diagram illustrating the relationship between rotational speed of the external fan device and the condensation temperature.
Figure 6:
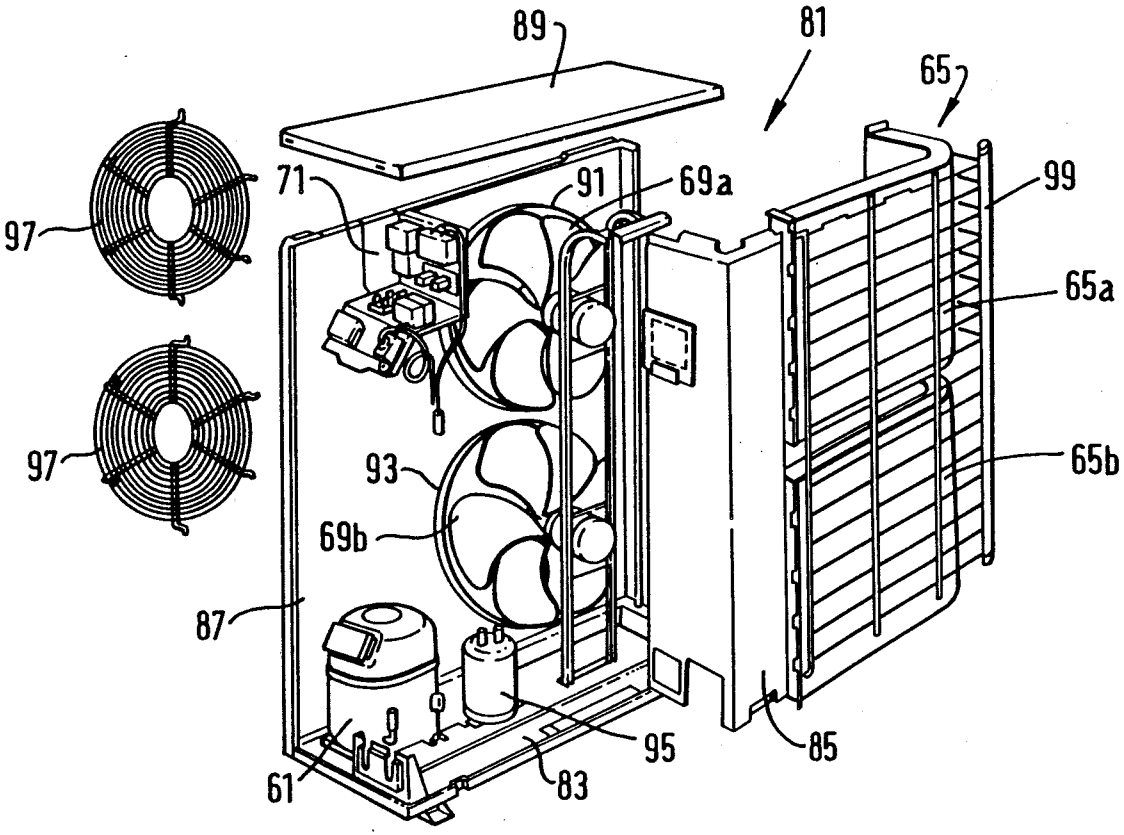
FIG. 6 is an exploded view illustrating an external unit assembly used in the refrigerating circuit of the embodiment shown in FIG. 4.

An assembled construction of external unit 55 will be described hereafter. As shown in FIG. 6, an external casing 81 includes a base plate 83, a front wall 85, a left-hand side wall 87, a top plate 89 and external heat-exchanger 65 composed of upper side external heat-exchanger 65*a* and lower side external heat-exchanger 65*b*. External heat-exchanger 65 is formed in L-shape to constitute a right-hand side wall and a back side wall of external casing 81. Upper and lower openings 91 and 93 are defined at left-hand side wall 87, in a vertical direction, opposite to upper and lower side external heat-exchangers 65*a* and 65*b*. Two fans 69*a* and 69*b* are respectively arranged facing upper and lower openings 91 and 93. Compressor 61 and a refrigerating circuit component 95 are fixed on base plate 83. Control circuit 71 is disposed at the upper part of external casing 81. Each opening 91, 93 is covered with a meshed guard 97. External heat-exchanger 65 also is covered with a net structure 99. As shown in FIGS. 4 and 5, in the above-described external unit 55, a first sensor 101, e.g., thermistor, is disposed at one end 102 of the upper-most fluid pipe $65a_1$ of upper side heat-exchanger 65*a*. The one end 102 of the upper-most fluid pipe $65a_1$ is the discharge side during cooling. In particular, first sensor 101 is arranged along the vertical pipe portion 102*a* of the one end 102 (discharge side) of the upper-most fluid pipe $65a_1$. The output signal from first sensor 101 is fed to control circuit 71, and thus, the rotation speed of fan device 69*a* (upper side fan) is controlled by control circuit 71 in accordance therewith. When air conditioning apparatus 51 carries out a cooling operation in a middle season, i.e., spring or fall, the rotation speed of fan device 69*a* is controlled at a prescribed high speed H if the condensation temperature detected by first sensor 101 increases. Otherwise, the rotation speed of fan device 69*a* is controlled at a prescribed low speed L by control circuit 71, as shown in FIG. 7. The rotation speed of the other fan device 69*b* (lower side fan) is maintained at a prescribed high speed level during the cooling operation. A second sensor 103 is disposed at one end 104 of the lower-most fluid pipe $65b_3$ of lower side external heat-exchanger 65*b*, which is the discharge side during cooling. Second sensor 103 detects the defrost state of external heat-exchanger 69 during a defrosting operation. The output signal of second sensor 103 is fed to control circuit 71, and control circuit 71 determines whether the defrosting operation is completed on the basis of the output signal fed from second sensor 103. The temperature of the one end 104 of the lower-most fluid pipe $65b_3$ detected by second sensor 103 rapidly increases when frost on external heat-exchanger 69 is completely removed. As is well known, upper and lower side fan devices 69*a* and 69*b* are stopped during a defrosting operation.

Figure 1:
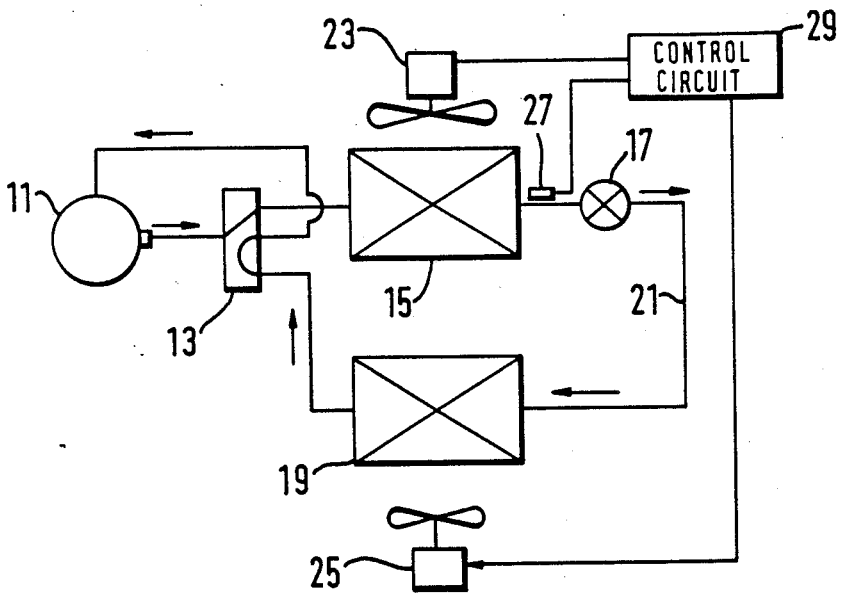
FIG. 1 (PRIOR ART)
FIG. 1 is a circuit diagram illustrating a refrigerating circuit of a conventional air conditioning apparatus.
Figure 2:
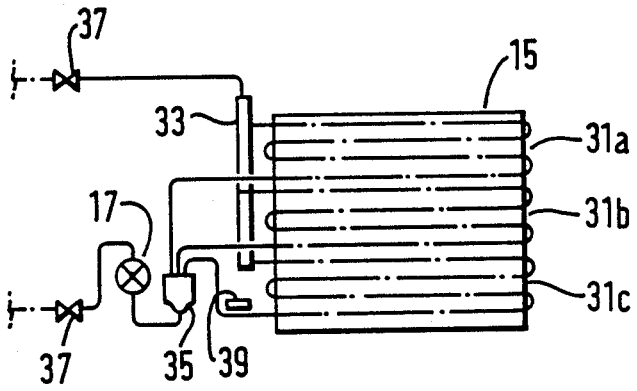
FIG. 2 (PRIOR ART)
FIG. 2 is a schematic view illustrating a conventional external heat-exchanger having a plurality of fluid passages.
Figure 3:
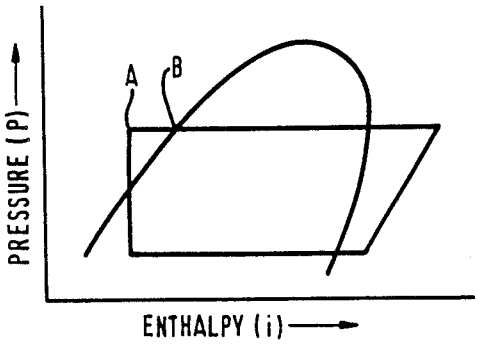
FIG. 3 is a mollier diagram illustrating the state of refrigerant during a refrigerating cycle.

Operation of the above-described air conditioning apparatus will be described hereafter. In a heating operation, four-way valve 63 is turned to the heating side. Refrigerant compressed by compressor 61 is fed to internal heat-exchanger 57 through four-way valve 63. The refrigerant discharges heat and is liquidized while the refrigerant flows through internal heat-exchanger 57. Then, refrigerant flows into each fluid pipe $65a_1$, $65a_2$, $65a_3$, $65b_1$, $65b_2$, $65b_3$, of upper and lower side external heat-exchangers 65*a* and 65*b* through decompression device 67 and collector 77. Refrigerant absorbs heat from the external air, and is gasified while refrigerant flows through external heat-exchangers 65*a* and 65*b*. Then, refrigerant returns to compressor 61 through four-way valve 63 after refrigerant flowing from each fluid pipe $65a_1$, $65a_2$, $65a_3$, $65b_1$, $65b_2$, $65b_3$ is collected in header pipe 75. The above-described cycle is repeatedly carried out to heat a defined space. During the heating operation, upper and lower side fan devices 69a and 69b are controlled at a prescribed high rotational speed. In a mild season, i.e., spring or autumn, a cooling operation is needed when the temperature or humidity in the defined space increases even though the external temperature is relatively low. In a cooling operation during such a mild season, a small cooling capacity is required as compared with summer. In such a cooling operation, four-way valve 63 is positioned at the cooling side. Refrigerant from compressor 61 is fed to upper and lower side external heat-exchangers 65a and 65b through four-way valve 63 and header pipe 75. The refrigerant discharges heat, and is liquidized while the refrigerant flows through each fluid pipe $65a_1$, $65a_2$, $65a_3$, $65b_1$, $65b_2$, $65b_3$ of external heat-exchangers 65a and 65b. The liquidized refrigerant flows into internal heat-exchanger 57 through decompression device 67. Refrigerant absorbs heat from a defined space (cooling), and is gasified while flowing through internal heat-exchanger 57. Then, the gasified refrigerant returns to compressor 61 through four-way valve 63. During the cooling operation described above, first sensor 101 detects the temperature of the discharge side 102 of the upper-most fluid pipe $65a_1$ of upper side external heat-exchanger 65, i.e., the condensation temperature of external heat-exchanger 65, and outputs a signal representing the condensation temperature to control circuit 71. Since first sensor 101 is arranged along vertical pipe portion 102a of the one end 102 (discharge side) of the upper-most fluid pipe $65a_1$ where liquidized refrigerant easily flows because of its gravity, first sensor 101 can detect a temperature substantially equal to the condensation saturated temperature indicated by point B in FIG. 3. As can be understood from FIG. 3, the condensation saturated temperature responds to changes in the condensation pressure. Therefore, first sensor 101 indirectly detects the condensation pressure by detecting the condensation temperature. As stated before, first sensor 101 outputs a detection signal indicating the condensation temperature to control circuit 71. Since the condensation temperature is low because of the low external temperature, the rotation speed of upper side fan device 69a is decreased to a prescribed low level by control circuit 71 in accordance with the detection signal fed from first sensor 101. Thus, the amount of air flowing through upper side external heat-exchanger 65a decreases, and thereby, the condensation pressure gradually increases. On the other hand, if the condensation temperature increases because of an increase of the external temperature, the rotation speed of upper side fan device 69a is increased to a prescribed high level by control circuit 71. Thus, the amount of air flowing through upper side external heat-exchanger 65a increases, and the condensation pressure gradually decreases. During the above-described rotation speed control against upper side fan device 69a, the rotation speed of lower side fan device 69b is maintained at a prescribed high level. Since a relatively small cooling capacity is needed during cooling in a middle season, the condensation pressure can be controlled within a prescribed range by controlling the rotation speed of only upper side fan device 69a. Furthermore, since first sensor 101 is located at upper side external heat-exchanger, first sensor 101 is affected by heat radiated from lower side external heat-exchanger 65b. Thus, first sensor 101 may rapidly respond to changes in the condensation temperature of external heat-exchanger 65. In general, a decrease in condensation pressure occurs when the external temperature decreases, and liquid compression of the compressor or shortage of lubricating oil in the compressor is caused thereby. However, in the above-described embodiment, since first sensor 101 accurately detects changes in the condensation temperature corresponding to the condensation pressure liquid compression of compressor 61 or shortage of lubricating oil in compressor 61 caused by decreases of the condensation pressure may be prevented.

With the above-described embodiment, since first sensor 101 is disposed at one end of the upper-most fluid pipe $65a_1$ of upper side external heat-exchanger 65a, which is the discharge side during cooling, first sensor 101 accurately may detect changes in condensation temperature corresponding to the condensation pressure. Thus, the condensation pressure is controlled within a prescribed range. Furthermore, only one of the upper and lower fan devices must be controlled to maintain the condensation pressure, resulting in a reduction in cost.

In the above-described embodiment, the present invention is applied to a heat-pump type air conditioning apparatus. However, the present invention may be applied to an air conditioning apparatus which carries out only a cooling operation.

The present invention has been described with respect to a specific embodiment. However, other embodiments based on the priciples of the present invention should be obvious to those of ordinary skill in the art. Such embodiments are intended to be covered by the claims.

What is claimed is:

1. An external unit for an air conditioning apparatus including an internal unit having an internal heat-exchanger and an internal fan device, the external unit comprising:

compressing means for compressing refrigerant;

at least upper and lower side external heat-exchangers arranged in a vertical direction for condensing refrigerant from the compressing means, the upper and lower side external heat-exchangers each having a fluid pipe of a defined length connected in parallel to one another;

temperature detection means, thermally contacting the fluid pipe of the upper side external heat-exchanger, for detecting the condensation temperature of the upper side external heat exchanger at a location of the fluid pipe of the upper side external heat-exchanger where changes in the condensation temperature correspond to changes in the condensation pressure of the upper side external heat-exchanger; and means responsive to the temperature detection means for controlling the condensation pressure of the upper side external heat-exchanger within a prescribed range.

2. An external unit according to claim 1, wherein the controlling means includes an external fan device for supplying air to the upper side external heat-exchanger, and means for regulating rotation speed of the external fan device in response to the temperature detection means.

3. An external unit according to claim 1 wherein the controlling means includes at least upper and lower side external fan devices opposite to the corresponding upper and lower side external heat-exchangers for supplying air to the upper and lower side external heat-exchangers, and means for regulating rotation speed of the upper side external fan device in response to the temperature detection means.

4. An air conditioning apparatus which carries out at least a cooling operation, comprising:

compressing means for compressing refrigerant;

external heat-exchanger means for condensing refrigerant from the compressing means during the cooling operation, the external heat-exchanger means including at least a lower side heat-exchanger means including at least a lower side heat-exchanger element and an upper side heat-exchanger element on the lower side heat-exchanger element, each heat exchanger element including a fluid pipe of a defined length connected in parallel to one another, the fluid pipe of the upper side heat-exchanger element having a discharge end for discharging refrigerant from the upper side heat-exchanger element during the cooling operation;

external fan means for supplying air to the external heat-exchanger means, the external fan means including at least upper and lower side fan devices, each opposite to a corresponding heat-exchanger element;

sensor means, thermally contacting the discharge end of the fluid pipe of the upper side heat-exchanger element, for detecting the condensation temperature of the external heat-exchanger means; and control means for controlling the rotation speed of the upper side fan device in response to the sensor means for maintaining the condensation pressure of the external heat-exchanger within a prescribed range.

5. An apparatus according to claim 4, wherein the discharge end of the fluid pipe of the upper side heat-exchanger element includes a vertical portion, and the sensor means includes a thermistor on the vertical portion.

6. An apparatus according to claim 4, wherein the external heat-exchanger means includes a header pipe connected to one end of the fluid pipe of each external heat-exchanger element.

7. An apparatus according to claim 6, wherein the external heat-exchanger means also includes a connector in fluid communication with the other end of the fluid pipe of each external heat-exchanger element.

8. A method for controlling the condensation pressure of an air conditioning apparatus having at least upper and lower side external heat-exchanger elements, upper and lower external fan devices opposite to the corresponding external heat-exchanger elements, and a temperature sensor, including the steps of:

generating a detection signal corresponding to the condensation temperature of the upper side external heat exchanger element from the temperature sensor; and controlling the rotation speed of the upper external fan device in response to the detection signal for maintaining the condensation pressure within a prescribed range.

9. An external unit for an air conditioning apparatus including an internal unit having an internal heat-exchanger and an internal fan device, the external unit comprising:

compressing means for compressing refrigerant;

at least upper and lower side external heat-exchangers arranged in a vertical direction for condensing refrigerant from the compressing means, the upper and lower side external heat-exchanger each having a fluid pipe of a defined length connected in parallel to one another, the fluid pipe of the upper side external heat-exchanger having a discharge end for discharging refrigerant from the upper side external heat-exchanger during the cooling operation;

temperature detection means, thermally contacting the discharge end of the fluid pipe of the upper side external heat-exchanger where changes in the condensation temperature correspond to changes in the condensation pressure of the upper side external heat-exchanger, for detecting the condensation temperature of the upper side external heat exchanger; and means responsive to the temperature detection means for controlling the condensation pressure of the upper side external heat-exchanger within a prescribed range.

* * * * *